US008029322B1

(12) United States Patent
Oh et al.

(10) Patent No.: US 8,029,322 B1
(45) Date of Patent: Oct. 4, 2011

(54) ELECTRICAL CONTACT ASSEMBLIES AND CONNECTORS INCLUDING RETENTION CLIPS

(75) Inventors: Lawrence Se-Jun Oh, Hummelstown, PA (US); Graham Henry Smith, Jr., Mechanicsburg, PA (US); Richard Vincent Lucente, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/891,118

(22) Filed: Sep. 27, 2010

(51) Int. Cl.
*H01R 13/502* (2006.01)

(52) U.S. Cl. ..... 439/695; 439/745

(58) Field of Classification Search ..... 439/607.03, 439/607.05–607.15, 744–749, 692–697
See application file for complete search history.

(56) References Cited

U.S. PATENT DOCUMENTS

| | | | | | |
|---|---|---|---|---|---|
| 3,475,720 | A | | 10/1969 | Culver | |
| 3,597,726 | A | * | 8/1971 | Appleton et al. | 439/724 |
| 3,697,935 | A | * | 10/1972 | Drapkin | 439/744 |
| 3,805,219 | A | * | 4/1974 | Bright | 439/692 |
| 3,808,590 | A | * | 4/1974 | Hemmer et al. | 439/692 |
| 4,333,703 | A | | 6/1982 | Anhalt et al. | |
| 4,378,103 | A | | 3/1983 | Sanford et al. | |
| 4,421,378 | A | | 12/1983 | Sanford et al. | |
| 4,701,004 | A | | 10/1987 | Yohn | |
| 4,776,816 | A | * | 10/1988 | Herscovici et al. | 439/744 |
| 4,804,243 | A | | 2/1989 | Borsuk et al. | |
| 4,854,899 | A | * | 8/1989 | Matthews | 439/724 |
| 5,567,179 | A | * | 10/1996 | Voltz | 439/578 |
| 5,575,691 | A | | 11/1996 | Matthews | |
| 5,643,016 | A | | 7/1997 | Huss, Jr. | |
| 5,856,806 | A | * | 1/1999 | Koleda | 343/702 |
| 5,934,945 | A | | 8/1999 | Peterson et al. | |
| 6,098,276 | A | * | 8/2000 | Espiritu | 29/764 |
| 6,299,491 | B1 | * | 10/2001 | Bruce | 439/745 |
| 6,319,073 | B1 | * | 11/2001 | Menolotto et al. | 439/744 |
| 6,498,506 | B1 | * | 12/2002 | Beckous | 324/755.02 |
| 6,554,645 | B1 | * | 4/2003 | Boemmel et al. | 439/595 |
| 6,758,577 | B2 | * | 7/2004 | Wu | 362/647 |
| 7,172,467 | B1 | * | 2/2007 | Yohn et al. | 439/686 |
| 7,736,199 | B2 | | 6/2010 | Cossette | |
| 7,780,482 | B2 | * | 8/2010 | Daubigney | 439/745 |
| 7,850,489 | B1 | * | 12/2010 | Feldman et al. | 439/607.1 |
| 7,931,507 | B2 | * | 4/2011 | Yu et al. | 439/744 |
| 2008/0020615 | A1 | * | 1/2008 | Feldman et al. | 439/162 |
| 2009/0104809 | A1 | * | 4/2009 | Feldman et al. | 439/374 |
| 2010/0029143 | A1 | * | 2/2010 | Cossette | 439/745 |

* cited by examiner

*Primary Examiner* — Ross Gushi

(57) ABSTRACT

An electrical connector that includes a plug insert having a dielectric body and having a pair of contact channels. The contact channels have central axes that extend parallel to each other in a common direction. The contact channels are defined by respective channel walls and are separated by an inter-channel portion of the dielectric body. The channel walls have wall perimeters that extend around the corresponding central axes. The electrical connector also has a contact sub-assembly that includes mating contacts that are received in the contact channels and retention clips that are positioned within the contact channels between the mating contacts and the channel walls. Each of the retention clips has a concave body with an open side. The concave body extends partially about the wall perimeter with the open side positioned along a portion of the wall perimeter. The retention clips are oriented to face one another.

20 Claims, 6 Drawing Sheets

ELECTRICAL CONTACT ASSEMBLIES AND CONNECTORS INCLUDING RETENTION CLIPS

BACKGROUND OF THE INVENTION

The invention relates generally to electrical connectors, and more particularly to electrical connectors for high-speed signal transmission.

Electrical connectors used to plug a communication cable into an electrical system may include a housing that contains several conductors that form differential pairs. The differential pairs are configured to connect with corresponding differential pairs in a mating connector of the electrical system when the pluggable and mating connectors are engaged. However, pluggable connectors that are currently used may have certain limitations due to unwanted electromagnetic coupling between the differential pairs. For example, the operating speeds of some known pluggable connectors are limited to transmission rates of less than those of gigabit Ethernet. If these pluggable connectors were to operate at speeds above gigabit Ethernet, unwanted electromagnetic coupling between the differential pairs would harm signal integrity and the performance of the connector. More specifically, increasing the operating speeds of the pluggable connectors may increase unwanted near-end crosstalk (NEXT), far-end crosstalk, and/or return loss such that the connector is unable to meet industry requirements for applications, such as gigabit Ethernet.

Accordingly, there is a need for pluggable connectors that are configured to reduce the negative effects of electromagnetic coupling. There is also a general need for pluggable connectors that are capable of operating at higher signal-transmission speeds and/or obtaining desired electrical performances.

BRIEF DESCRIPTION OF THE INVENTION

In one embodiment, an electrical connector is provided that includes a plug insert that has a dielectric body and a pair of contact channels extending therethrough. The contact channels have central axes that extend parallel to each other in a common direction. The contact channels are defined by respective channel walls and are separated by an inter-channel portion of the dielectric body. The channel walls have wall perimeters that extend around the corresponding central axes. The electrical connector also includes a contact sub-assembly that is held by the pair of contact channels. The contact sub-assembly includes mating contacts that are received in the contact channels and retention clips that are positioned within the contact channels between the mating contacts and the channel walls. Each of the retention clips have a concave body with clip edges separated by an open side. The concave body extends partially about the wall perimeter with the open side positioned along a portion of the wall perimeter. The retention clips are oriented to face one another such that the inter-channel portion extends directly between the open sides of the retention clips.

In another embodiment, an electrical connector is provided that includes a plug insert comprising a dielectric body and a plurality of contact channels extending therethrough. The contact channels have central axes that extend parallel to each other in a common direction. The contact channels are defined by respective channel walls. The channel walls have wall perimeters that extend around the corresponding central axes. The plurality of contact channels include associated pairs of contact channels. The contact channels of each of the associated pairs being separated by a corresponding inter-channel portion of the dielectric body. The electrical connector also includes a set of contact sub-assemblies that are held by the plug insert. Each of the contact sub-assemblies includes mating contacts that are received in one associated pair of contact channels. A contact plane extends through the central axes of said associated pair of contact channels. Each of the contact sub-assemblies also includes retention clips that are positioned within the contact channels. Each of the retention clips has a concave body with clip edges separated by an open side. The concave body extends partially about the corresponding wall perimeter with the open side positioned along a portion of the corresponding wall perimeter. The retention clips are oriented to face one another such that the inter-channel portion extends directly between the open sides of the retention clips. The set of contact sub-assemblies includes two adjacent contact sub-assemblies. The contact planes of the adjacent contact sub-assemblies extend perpendicular to each other.

DETAILED DESCRIPTION OF THE INVENTION

Figure 1:
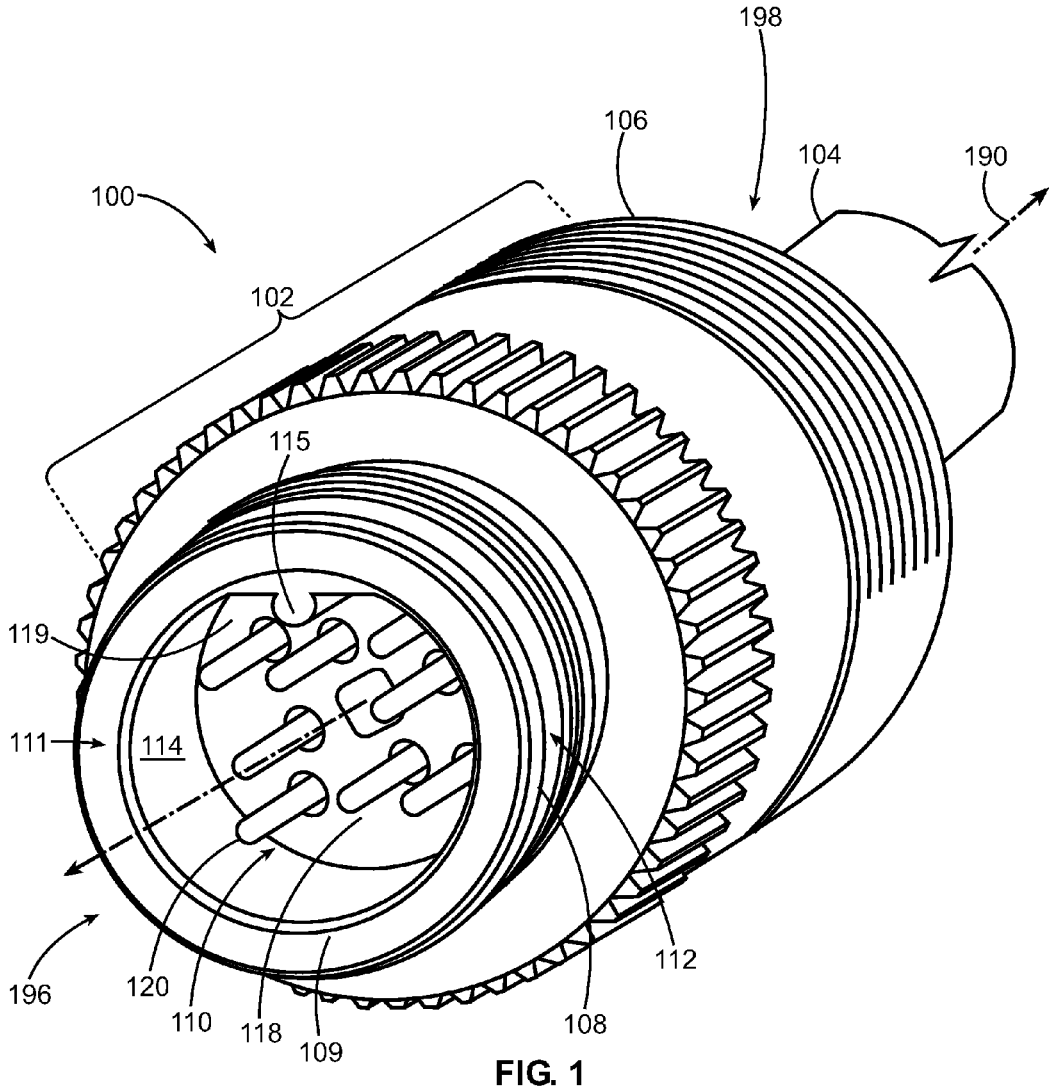
FIG. 1 is a perspective view of an electrical connector formed in accordance with one embodiment.

Embodiments described herein include electrical connectors having mating contacts configured to transmit data signals. The mating contacts may form differential pairs that are arranged to improve the performance of the electrical connectors with respect to other known connectors. For example, embodiments described herein have differential pairs arranged to reduce, control, or improve upon at least one of insertion loss, near-end crosstalk (NEXT), far-end crosstalk, and return loss. Furthermore, embodiments described herein utilize retention clips that facilitate assembling the electrical connectors and also facilitate holding the mating contacts when mating the electrical connector to another connector. In particular embodiments, the retention clips that engage adjacent mating contacts may be oriented with respect to each other to improve the performance of the electrical connector. For example, the retention clips may be symmetrically oriented in such a way that near-end crosstalk (NEXT) performance is optimized between the adjacent differential pair. Moreover, as compared to known electrical connectors, the retention clips may allow a uniform amount of dielectric material located between the mating contacts while, in some cases, permitting a tighter arrangement (or higher density) of mating contacts.

In particular embodiments, the electrical connectors are pluggable connectors. A "pluggable connector," as used herein, is an electrical connector that is configured to mate with another electrical connector (also referred to as a mating connector) through a pluggable engagement. A pluggable engagement is a removable engagement such that the two electrical connectors may be readily separated without damage to either of the connectors. Pluggable connectors described herein may include a plug insert that is configured to be inserted into a cavity of a mating connector. The pluggable connectors may also be receptacle connectors having a cavity that receives a plug insert from a mating connector. Accordingly, a connector assembly of two pluggable connectors may include a first pluggable connector having a plug insert that is inserted into a cavity of a second pluggable connector that has a cavity configured to receive the plug insert. By way of example only, embodiments described herein may be similar to: (a) a modular connector having a 16-contact, size 13 MIL-38999 insert; (b) a modular connector having an eight (8) contact insert in a size 7 or 9 MIL-38999 plug shell; (c) a modular connector having an eight (8) contact insert in a Quadrax-like metal shell; and (d) a modular connector having a 16+ contact insert in a Quadrax-like metal shell. In some embodiments, the electrical connectors may have circular cross-sections, such as the electrical connector 100 in FIG. 1. However, in alternative embodiments, the electrical connectors may have non-circular cross-sections, such as a polygonal cross-sections (e.g., rectangular, pentagonal) or semi-circle cross-sections.

In addition, the pluggable connectors may operate at high-speeds, such as those applied in gigabit Ethernet. In particular embodiments, the pluggable connectors may transmit signals at speeds such as those applied in 10G Ethernet. However, in other embodiments, the pluggable connectors may not operate at high speeds. Although various embodiments described herein are applicable for transmitting data signals, other embodiments may be configured to transmit electrical power in addition to data signals or only electrical power.

FIG. 1 is a perspective view of an electrical connector 100 formed in accordance with one embodiment. The electrical connector 100 may include a connector housing 102 that extends along a longitudinal axis 190 between a mating end 196 and a loading end 198. The connector housing 102 may be connected to a cable 104 at the loading end 198. In the illustrated embodiment, the electrical connector 100 has a substantially linear structure such that the entire connector housing 102 extends in a direction along the longitudinal axis 190. In alternative embodiments, the entire connector housing 102 might not extend along the longitudinal axis 190, but may be shaped as desired. For example, the connector housing 102 may have a right-angle structure. As shown, the connector housing 102 includes a main body 106 that includes the loading end 198 and is connected to the cable 104. The connector housing 102 also includes a mating wall 108 that projects from the main body 106 and extends along the longitudinal axis 190 to the mating end 196. The mating wall 108 also extends about or surrounds the longitudinal axis 190 to provide a housing cavity 110. The mating wall 108 includes a front edge 109 that defines an opening 111 of the housing cavity 110. The mating wall 108, the opening 111, and the housing cavity 110 may be sized and shaped to mate with a mating connector (not shown).

The mating wall 108 may have a cross-section taken perpendicular to the longitudinal axis 190 that is sized and shaped to engage the mating connector. More specifically, the cross-section of the mating wall 108 may be substantially circular. The mating wall 108 may also include a keying feature 115 to facilitate aligning the electrical connector 100 and the mating connector. Furthermore, the housing cavity 110 may be sized and shaped to receive a plug body from the mating connector. As shown, the mating wall 108 has an outer surface 112 and an inner surface 114 that defines the housing cavity 110. The outer surface 112 may be configured to fasten to the mating connector. For example, the outer surface 112 may be threaded and configured to engage complementary threads on an inner surface of the mating connector. However, in other embodiments, the inner surface 114 may be threaded and configured to engage complementary threads on an outer surface of the mating connector. In alternative embodiments, the electrical connector 100 may have other mechanisms for engaging the mating connector.

The electrical connector 100 also includes an organizer or plug insert 118 held by the connector housing 102. The plug insert 118 is located within the housing cavity 110 and includes a plurality of contact channels 125 (shown in FIG. 2) that extend through a dielectric body 119 of the plug insert 118. The dielectric body 119 comprises a dielectric material. The contact channels 125 are configured to hold mating contacts 120 of the electrical connector 100 in a predetermined arrangement. In the illustrated embodiment, the mating contacts 120 extend from the plug insert 118 toward the opening 111 and parallel to the longitudinal axis 190. The mating contacts 120 may be arranged in a predetermined configuration so that the mating contacts 120 electrically connect with mating contacts (not shown) of the mating connector. As shown in FIG. 1, the mating contacts 120 may be pin contacts. However, in other embodiments, the mating contacts 120 may be socket contacts that are configured to receive pin contacts.

Figure 2:
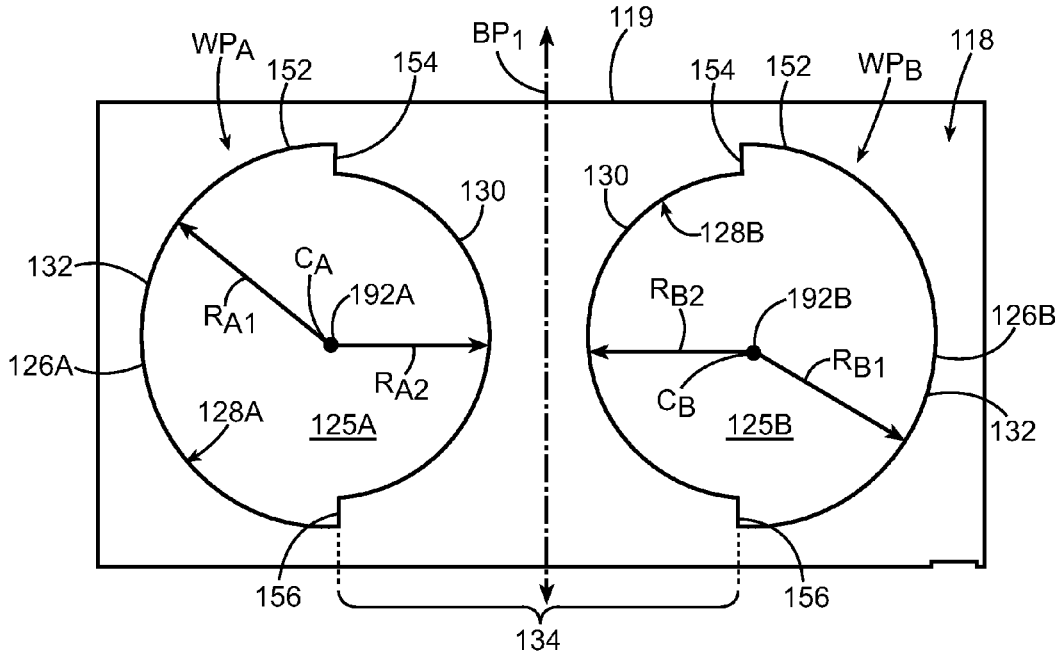
FIG. 2 is an enlarged cross-section of a pair of contact channels that may be used with the electrical connector of FIG. 1.

FIG. 2 is an enlarged cross-section of a portion of the plug insert 118 taken perpendicular to the longitudinal axis 190 (FIG. 1) and illustrates a pair of contact channels 125A and 125B. More specifically, FIG. 2 illustrates cross-sections of the contact channels 125A and 125B where retention clips 150A and 150B (shown in FIG. 3) may be located. The contact channels 125A and 125B extend through a portion of the dielectric body 119. In particular embodiments, the pair of contact channels 125A and 125B may also be referred to as an associated pair of contact channels in that the contact channels 125A and 125B are configured to receive a differential pair of mating contacts 120A and 120B (shown in FIG. 3). As shown, each of the contact channels 125A and 125B has a central axis 192A and 192B, respectively, that extends through a center of the respective contact channel. The central axes 192A and 192B extend parallel to each other in a common direction and also parallel to the longitudinal axis 190 (FIG. 1). In FIG. 2, the central axes 192A and 192B extend in a direction that is into and out of the page.

Figure 3:
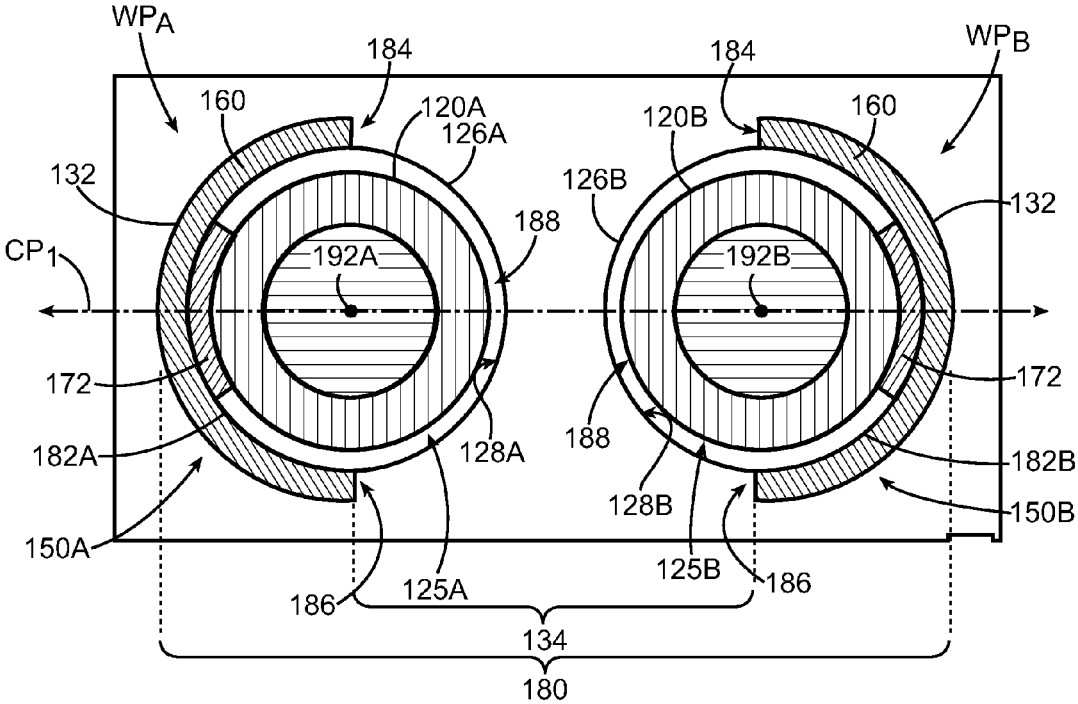
FIG. 3 is the enlarged cross-section of FIG. 2 illustrating mating contacts and retention clips disposed in the contact channels.

The contact channels 125A and 125B may be sized and shaped to receive the mating contacts 120A and 120B (FIG. 3) and the retention clips 150A and 150B (FIG. 3). As shown, the contact channels 125A and 125B are defined by respective channel walls 126A and 126B. The channel walls 126A and 126B include interior surfaces 128A and 128B of the dielectric body 119. The channel walls 126A and 126B and the interior surfaces 128A and 128B extend around the respective central axes 192A and 192B. Also, the channel walls 126A and 126B have wall perimeters $WP_A$ and $WP_B$ that extend around the corresponding central axes 192A and 192B, respectively. The wall perimeters $WP_A$ and $WP_B$ define cross-sections of the contact channels 125A and 125B taken perpendicular to the central axes 192A and 192B (or taken perpendicular to the longitudinal axis 190 (FIG. 1)). In other words, the wall perimeters $WP_A$ and $WP_B$ are viewed in a direction along the respective central axes 192A and 192B. The wall perimeters $WP_A$ and $WP_B$ may form a closed-plane curve (e.g. circle, ellipse, rectangle, and the like, or a combination of geometric shapes). For example, in the illustrated embodiment, the wall perimeters $WP_A$ and $WP_B$ include two semi-circles that are differently sized.

As shown, each of the channel walls 126A and 126B may include an inner wall section 130 and an outer wall section 132. The inner wall sections 130 of the different contact channels 125A and 125B are located adjacent to each other. The outer wall sections 132 are located away from each other.

Also shown, an inter-channel portion 134 of the dielectric body 119 may separate the contact channels 125A and 125B. The inter-channel portion 134 extends directly between the inner wall sections 130. The inter-channel portion 134 includes the interior surfaces 128A and 128B that define the inner wall sections 130. More specifically, the inter-channel portion 134 may be defined from the interior surface 128A of the inner wall section 130 of the contact channel 125A to the interior surface 128B of the inner wall section 130 of the contact channel 125B. Furthermore, the inter-channel portion 134 may partially define the wall perimeters $WP_A$ and $WP_B$. In the illustrated embodiment, the inter-channel portion 134 is substantially I-shaped. Also shown, the contact channels 125A and 125B may be symmetric with respect to a body plane $BP_1$ that extends between the contact channels 125A and 125B and bisects the inter-channel portion 134. The body plane $BP_1$ may be perpendicular to a contact plane $CP_1$ (shown in FIG. 3).

In the illustrated embodiment, the inner wall sections 130 and the outer wall sections 132 have semi-circle shapes (or semi-circle contours). More specifically, the inner wall sections 130 and the outer wall sections 132 may have respective radiuses of curvature. The radiuses of curvature of the inner wall section 130 and the outer wall section 132 may be different. As shown, a radius $R_{A1}$ is measured from a common center $C_A$ and extends to the interior surface 128A of the outer wall section 132, and a radius $R_{A2}$ is measured from the center $C_A$ that extends to the interior surface 128A of the inner wall section 130. The radius $R_{A1}$ is greater than the radius $R_{A2}$. The radiuses $R_{A1}$ and $R_{A2}$ may define different radiuses of curvature. In addition, the inner and outer wall sections 130 and 132 of the contact channel 125B may have similar radiuses $R_{B1}$ and $R_{B2}$ that are measured from a common center $C_B$ of the contact channel 125B. The radius $R_{B1}$ is greater than the radius $R_{B2}$.

The outer wall sections 132 of the contact channels 125A and 125B may be substantially C-shaped. In the illustrated embodiment, the outer wall sections 132 are half-circles. However, in other embodiments, the outer wall sections 132 may be slightly more than half-circles or may be less than half-circles. For example, the outer wall sections 132 may be quarter-circles. The outer wall sections 132 may also have other shapes that are not circular.

The outer wall sections 132 may include body segments 152 and radial segments 154 and 156. The radial segments 154 and 156 extend in a radial direction (i.e., away from the central axis 192) with respect to opposite ends of the corresponding body segments 152. The body segments 152 may be defined by the respective radiuses of curvature of the outer wall sections 132 of the contact channels 125A and 125B. More specifically, curves made by rotating the radiuses $R_{A1}$ and $R_{B1}$ from the centers $C_A$ and $C_B$, respectively, may form a shape of the body segments 152. In the illustrated embodiment, the radiuses $R_{A1}$ and $R_{B1}$ are substantially equal and the radiuses $R_{A2}$ and $R_{B2}$ are substantially equal. Also, in the illustrated embodiment, the radiuses $R_{A1}$ and $R_{A2}$ and the radiuses $R_{B1}$ and $R_{B2}$ are measured from the common center $C_A$ and the common center $C_B$, respectively. However, in alternative embodiments, the radiuses $R_{A1}$ and $R_{A2}$ and the radiuses $R_{B1}$ and $R_{B2}$ may have different centers of the radiuses of curvature.

FIG. 3 is the enlarged cross-section of the portion of the plug insert 118 shown in FIG. 2 illustrating a contact sub-assembly 180. The contact sub-assembly 180 is held by the pair of contact channels 125A and 125B. The contact sub-assembly 180 includes the mating contacts 120A and 120B and the retention clips 150A and 150B disposed within the contact channels 125A and 125B. The retention clips 150A and 150B are positioned within the contact channels 125A and 125B between the corresponding mating contacts 120A and 120B and the respective channel walls 126A and 126B. More specifically, the outer wall sections 132 of the contact channels 125A and 125B may engage the retention clips 150A and 150B within the contact channels 125A and 125B.

As shown in FIG. 3, each of the retention clips 150A and 150B has a concave body 160. Each of the concave bodies 160 extends between clip edges 184 and 186. The clip edges 184 and 186 are separated by an open side 188. The open side 188 may also be characterized as an air gap formed in the contact channel 125 that is located generally between the clip edges 184 and 186, the mating contact 120, and inner wall section 130 of the channel wall 126. Each of the concave bodies 160 extends partially about the corresponding wall perimeter $WP_A$ and $WP_B$ with the open side 188 positioned along a portion of the wall perimeter $WP_A$ and $WP_B$. The retention clips 150A and 150B are oriented to face one another such that the inter-channel portion 134 extends directly between the open sides 188 of the retention clips 150A and 150B. The retention clips 150A and 150B may diametrically oppose each other. In the illustrated embodiment, the retention clips 150A and 150B have identical structures. However, in alternative embodiments, the retention clips 150A and 150B may have different structures.

The outer wall sections 132 are configured to accommodate or fit the corresponding retention clips 150A and 150B so that the retention clips 150A and 150B permit the mating contacts 120A and 120B to be inserted therethrough. The outer wall sections 132 may have various shapes to hold the retention clips 150A and 150B. Thus, embodiments are not limited to having contact channels (or outer wall sections) with semi-circular shapes, but may have other shapes to accommodate the retention clip.

Also shown in FIG. 3, the central axes 192A and 192B of the contact sub-assembly 180 may extend parallel to and within a contact plane $CP_1$. In the illustrated embodiment, the contact plane $CP_1$ intersects the mating contacts 120A and 120B, the inter-channel portion 134, the open sides 188, and the concave bodies 160 of the retention clips 150A and 150B. Moreover, the only matter (or material other than air or gas) that may be located between the mating contacts 120A and 120B may exclusively be the dielectric material of the dielectric body 119. In such cases, electromagnetic coupling between the mating contacts 120A and 120B may be optimized. Thus, as compared to known electrical connectors, the retention clips 150A and 150B may allow a uniform amount of dielectric material located between adjacent mating contacts 120A and 120B. In some embodiments, the retention clips 150A and 150B also permit a tighter arrangement (or density) of mating contacts 120 in the electrical connector 100 (FIG. 1).

In alternative embodiments, the retention clips 150A and 150B may also be used to improve a dielectric breakdown strength between mating contacts that transmit electrical power. For example, the retention clips 150A and 150B may reduce the proximity of the mating contacts with respect to each other. Moreover, as compared to known electrical connectors, the retention clips 150A and 150B may allow an increased amount of dielectric material located between the mating contacts. As such, the retention clips 150A and 150B may prevent or reduce arcing between the mating contacts that transmit electrical power.

Figure 4:
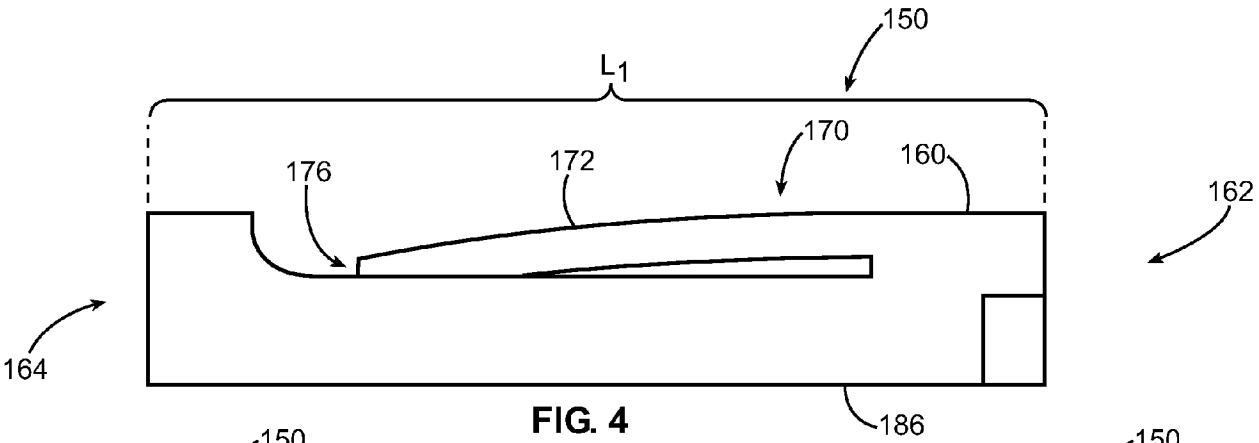
FIG. 4 is an isolated side view of a retention clip that may be used with the electrical connector of FIG. 1.
Figure 6:
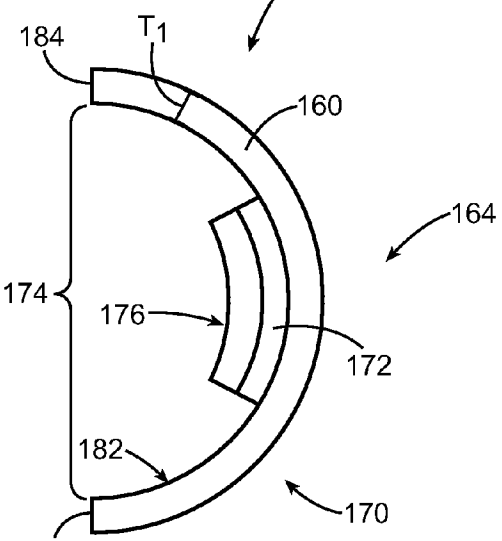
FIG. 6 is a plan view of the trailing end of the retention clip of FIG. 4.
Figure 5:
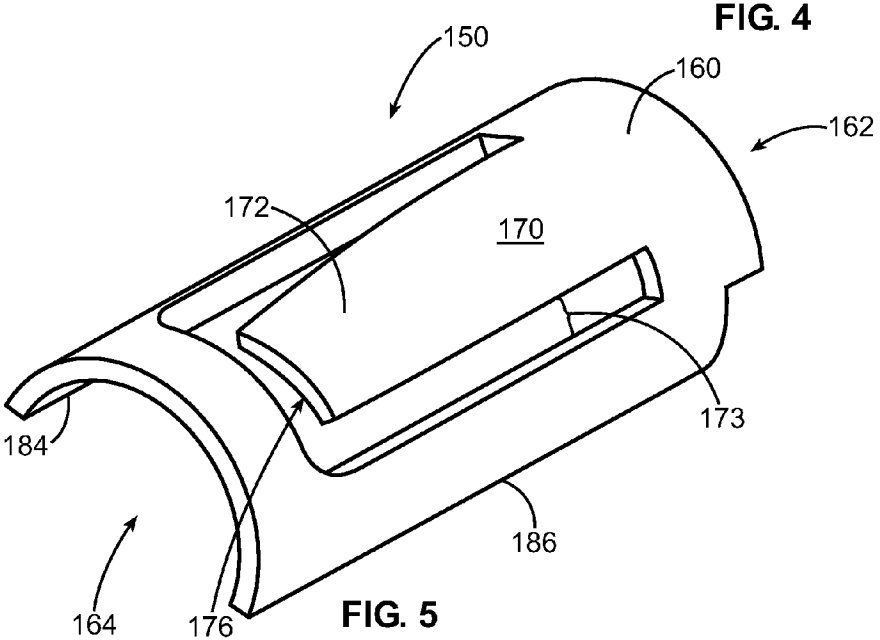
FIG. 5 is a perspective view of the retention clip of FIG. 4.

FIGS. 4-6 illustrate an exemplary retention clip 150 in greater detail. As shown, the retention clips 150 have a concave body 160 that extends longitudinally between leading and trailing ends 162 and 164. The concave body 160 also extends between opposite clip edges 184 and 186. As shown, the retention clip 150 may have a length $L_1$ (FIG. 4) measured between the leading and trailing ends 162 and 164, and the retention clip 150 may have a thickness $T_1$ (FIG. 6) measured between an outer or wall surface 170 and an inner or channel surface 182 (FIG. 6). In the illustrated embodiment, the thickness $T_1$ is substantially uniform, but the thickness $T_1$ may vary in other embodiments. Moreover, in the illustrated embodiment, the retention clip 150 may be stamped and formed from a resilient and deformable sheet material. However, other manufacturing processes may be used.

Also shown in FIGS. 4-6, the retention clip 150 may include a resilient flex finger 172 that extends from the leading end 162 and toward the trailing end 164. The flex finger 172 may be outlined by a stamped void 173. The flex finger 172 is configured to engage the corresponding mating contact 120 when the mating contact 120 is inserted into the corresponding contact channel 125. The flex finger 172 may extend to a distal edge 176. In a relaxed condition, the flex finger 172 extends away from the inner surface 182.

With specific reference to FIG. 6, the retention clip 150 may define a contact-reception space 174 that is located along the inner surface 182 and between the clip edges 184 and 186. As the flex finger 172 extends longitudinally from the leading end 162 to the trailing end 164, the flex finger 172 may extend into the contact-reception space 174 such that the distal edge 176 is located within the contact-reception space 174. With respect to the central axis 192 (FIG. 2) of a corresponding contact channel 125, the flex finger 172 may extend at least partially toward the central axis 192 (i.e., at least partially in a radial direction). For example, the flex finger 172 may curve into the contact-reception space 174 or extend in a linear manner from the leading end 162.

Returning to FIG. 3, the retention clips 150A and 150B are shaped to permit the mating contacts 120A and 120B to be freely moved through the contact channels 125A and 125B. The retention clips 150A and 150B and the wall perimeters $WP_A$ and $WP_B$ may be configured to permit the mating contacts 120A and 120B to be inserted therethrough so that the mating contacts 120A and 120B are not obstructed (e.g., so that the mating contacts 120A and 120B are not snagged or do not catch parts of the retention clips 150A and 150B). For example, in the illustrated embodiment, the inner surfaces 182A and 182B of the retention clips 150A and 150B are substantially flush with the interior surfaces 128A and 128B, respectively. When the mating contacts 120A and 120B are inserted through the contact channels 125A and 125B, the flex fingers 172 may engage the mating contacts 120A and 120B and facilitate holding (e.g., retaining) the mating contacts 120A and 120B within the contact channels 125A and 125B. For example, the flex fingers 172 may prevent the mating contacts 120 from moving in at least one direction along the central axis 192.

Figure 7:
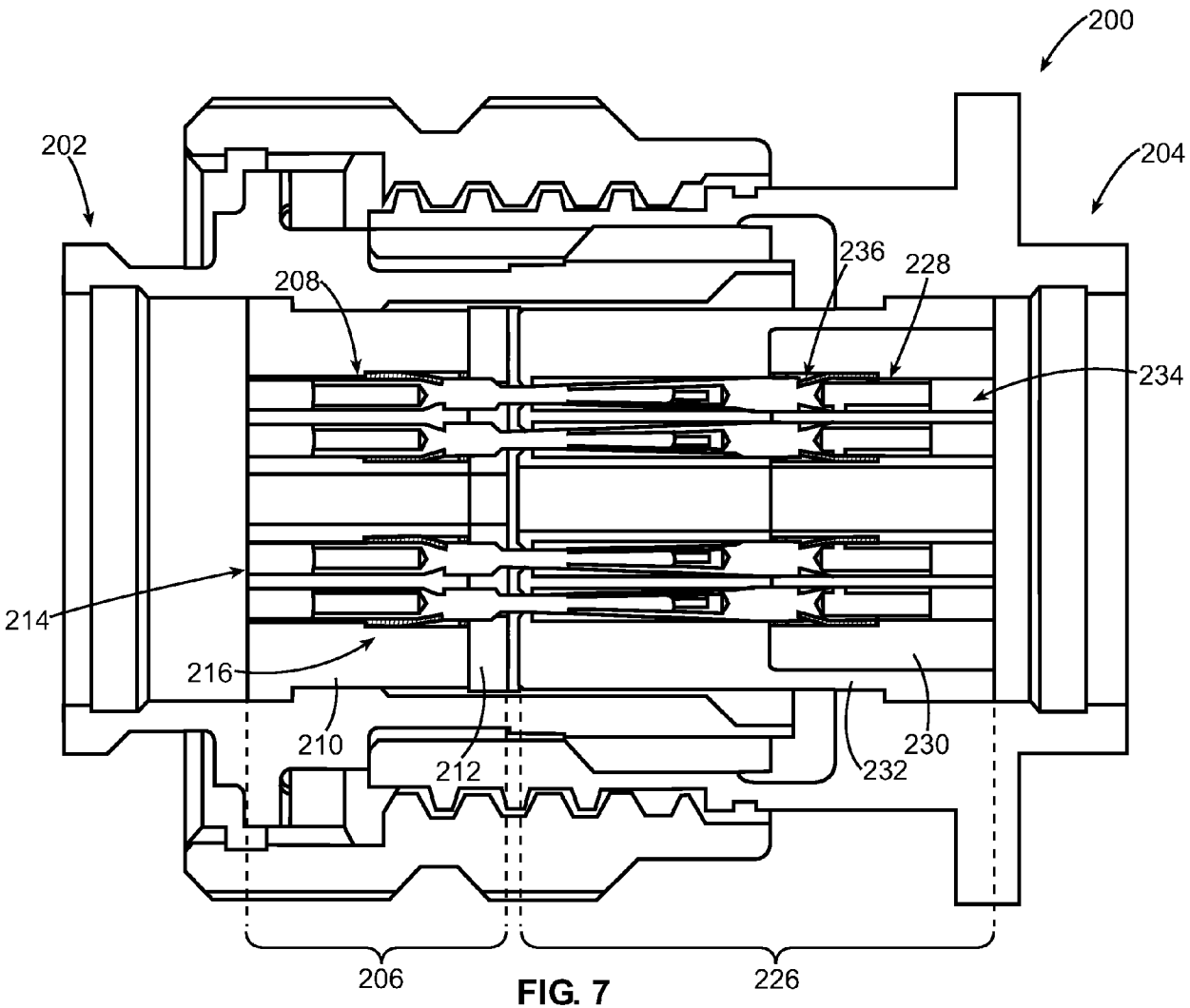
FIG. 7 is a cross-section of an electrical connector assembly formed in accordance with one embodiment.

FIG. 7 is a cross-section of an electrical connector assembly 200 formed in accordance with one embodiment. The connector assembly 200 includes a first pluggable connector 202 and a second pluggable connector 204. The first and second pluggable connectors 202 and 204 may be similar to the electrical connector 100 shown in FIG. 1. The pluggable connector 202 includes a plug insert 206 that comprises a base body 210 and a cap body 212 that interface with each other to form the plug insert 206. The plug insert 206 includes a plurality of contact channels 214 that are configured to hold mating contacts 208 (herein referenced as pin contacts 208) and retention clips 216. The pin contacts 208 and the retention clips 216 may be similar to the mating contacts 120 (FIG. 1) and the retention clips 150 (FIG. 3) described above.

Likewise, the pluggable connector 204 includes a plug insert 226 that comprises a base body 230 and a cap body 232 that interface with each other to form the plug insert 226. The plug insert 226 includes a plurality of contact channels 234 configured to hold mating contacts 228 (herein referenced as socket contacts 228) and retention clips 236. The socket contacts 228 and the retention clips 236 may be similar to the mating contacts 120 (FIG. 1) and the retention clips 150 (FIG. 3) described above. However, as shown in FIG. 7, when the pluggable connectors 202 and 204 are properly aligned and engaged, the socket contacts 228 receive and engage the pin contacts 208 to establish an electrical connection therebetween.

Figure 8:
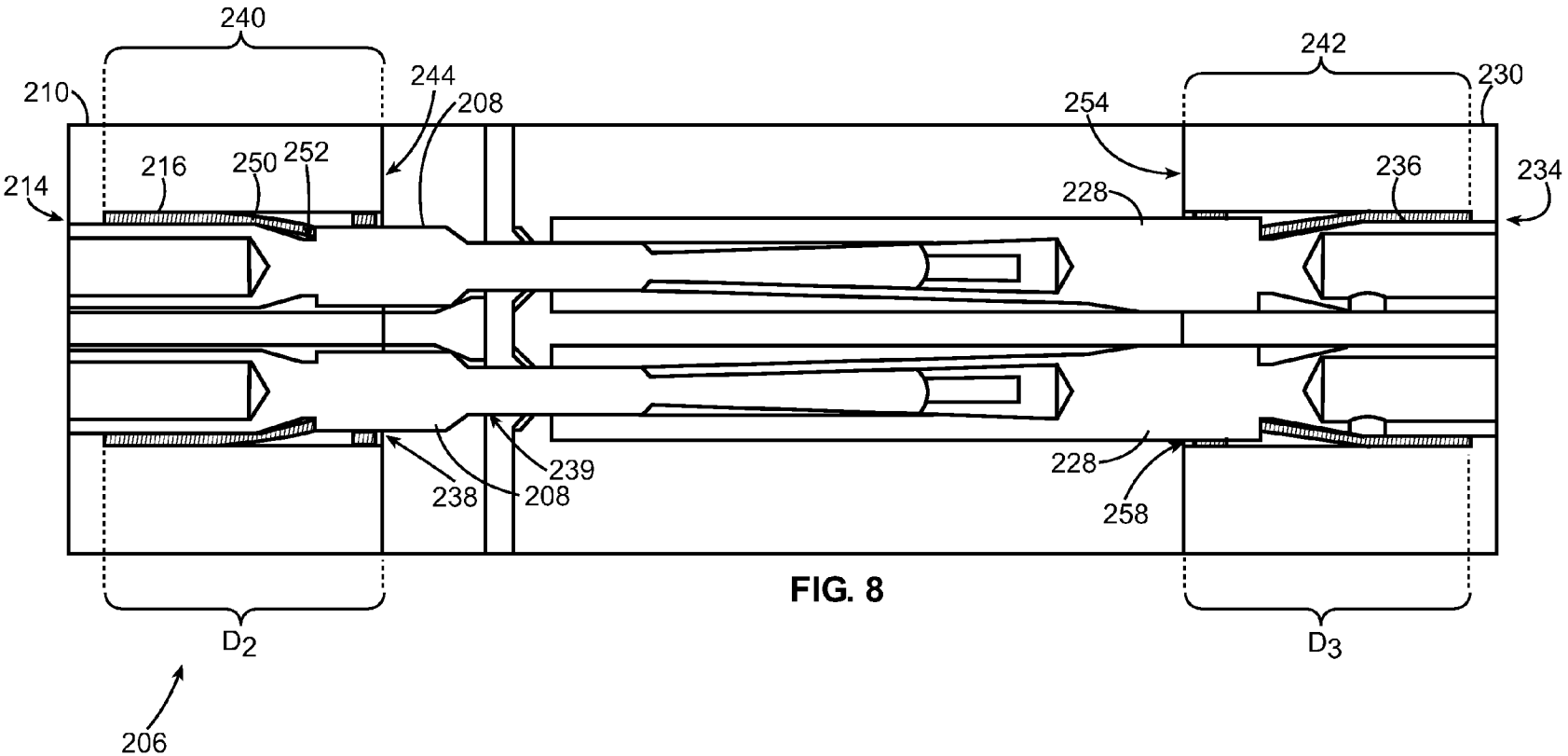
FIG. 8 is an enlarged side cross-section of the connector assembly of FIG. 7.

FIG. 8 is an enlarged side cross-section of the connector assembly 200 (FIG. 7) illustrating the pin and socket contacts 208 and 228 engaged with each other. As shown, the contact channels 214 and 234 of the base bodies 210 and 230, respectively, include corresponding clip regions 240 and 242. The clip regions 240 and 242 are sized and shaped to receive the retention clips 216 and 236, respectively. The clip regions 240 and 242 may, for example, have wall perimeters that are similar to the wall perimeters $WP_A$ and $WP_B$ described with respect to FIGS. 2 and 3. In addition, the base body 210 has a forward-facing surface 244 that includes openings 238. The base body 230 has a forward-facing surface 254 that includes openings 258. As shown, the clip regions 240 and 242 extend depths $D_2$ and $D_3$, respectively, into the base bodies 210 and 230 from the forward-facing surfaces 244 and 254. The depths $D_2$ and $D_3$ are approximately equal to or greater than a length of the retention clips 216 and 236 (such as the length $L_1$ of the retention clip 150 (FIG. 4)).

To construct the pluggable connector 202, the retention clips 216 are inserted through the openings 238 of the base body 210, which provide access to the clip regions 240. The cap body 212 may then be engaged to the forward-facing surface 244 of the base body 210. The cap body 212 may have corresponding holes 239 that align with the openings 238 of the base body 210. When the cap body 212 is attached to the forward-facing surface 244 of the base body 210 to form the plug insert 206, the retention clips 216 may be confined within the clip regions 240 of the plug insert 206. The pin contacts 208 may then be advanced into the contact channels 214. As the pin contacts 208 are received by the contact channels 214, the pin contacts 208 engage flex fingers 250 of the retention clips 216 and deflect the flex fingers 250 radially outward. The flex fingers 250 slide along a surface of the pin contact 208. When the flex finger 250 clears a recess or groove 252 that extends along the pin contact 208, the flex finger 250 may move (e.g., resile) into the groove 252 to engage the pin contact 208. Once engaged, the pin contact 208 is not permitted to move rearwardly in an axial direction unless a removal tool is inserted into the contact channel 234 and used to deflect the flex finger 250. For example, when the pluggable connector 202 engages the pluggable connector 204, the retention clip 216 or, more particularly, the flex finger 250 may provide a positive stop to rearward movement of the pin contacts 208 when the pin contacts 208 engage the socket contacts 228. The pluggable connector 204 may be constructed in a similar manner as the pluggable connector 202.

Figure 9:
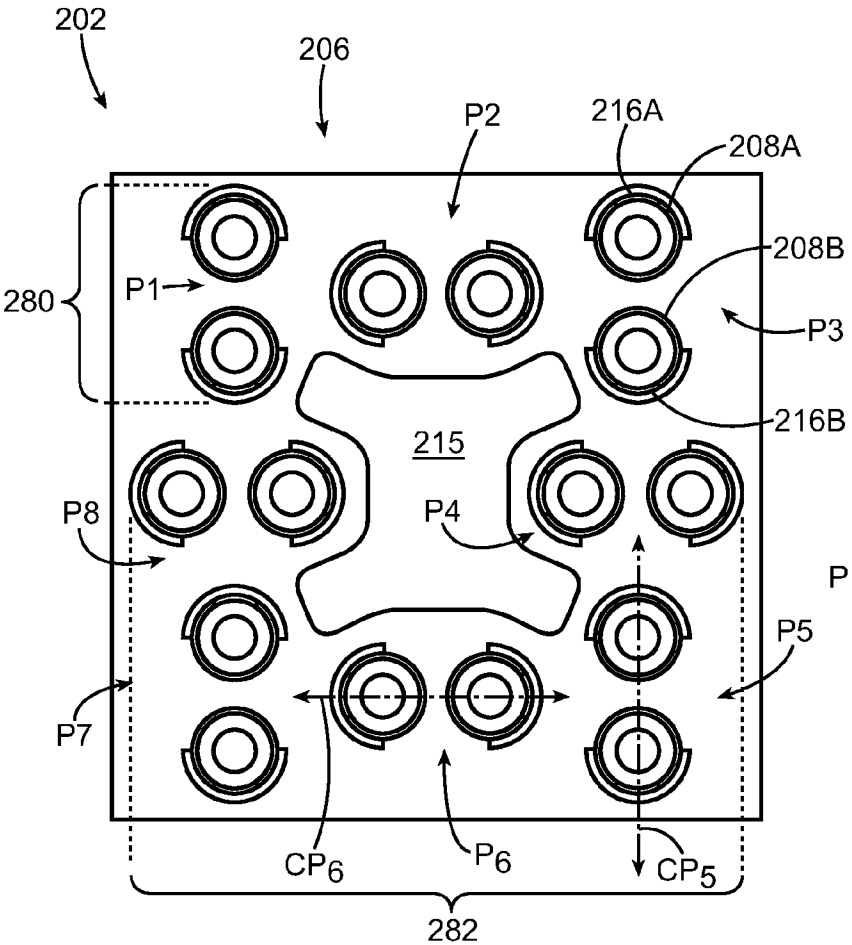
FIG. 9 is a front-end view of an electrical connector that may be used with the connector assembly of FIG. 7.

FIG. 9 is a front-end view of the electrical connector 202 illustrating pin contacts 208 arranged in a set 282 of contact sub-assemblies 280. Although the following is with specific reference to pin contacts, the following description of arranging the pin contacts with respect to each other may similarly be applied to socket contacts. As shown in FIG. 9, two pin contacts 208 may form a differential pair P. More specifically, a plurality of pin contacts 208 may form a plurality of differential pairs P1-P8. Each differential pair P has one pin contact 208 having a positive polarity and another pin contact 208 having a negative polarity (i.e., one pin contact 208 transmits a signal current that is about 180° out-of-phase with the other pin contact 208). Each differential pair P1-P8 may comprise a contact sub-assembly 280 that includes the pin contacts 208A and 208B and corresponding retention clips 216A and 216B. Also shown, the plug insert 206 may have an air dielectric or plug cavity 215 extending through a center of the plug insert 206.

The differential pairs P1-P8 (or contact sub-assemblies 280) may be arranged with respect to each other in order to minimize unwanted electromagnetic coupling between the pin contacts 208 of the differential pairs P1-P8. For example, in some embodiments, adjacent differential pairs P (or contact sub-assemblies 280) may have predetermined orientations with respect to each other. As used herein, two differential pairs are "adjacent" to one another when the two differential pairs of mating contacts do not have (a) any other mating contact of another differential pair located between the two differential pairs or (b) an air dielectric located between the two differential pairs. Furthermore, adjacent differential pairs are relatively close to one another as compared to other differential pairs. For example, in FIG. 9, the differential pair P1 is adjacent to the differential pairs P2 and P8. However, the differential pairs P2 and P8 are not adjacent to each other.

In the illustrated embodiment, adjacent differential pairs P (or contact sub-assemblies 280) are oriented substantially perpendicular to one another. For example, each of the differential pairs P5 and P6 have a contact plane $CP_5$ and $CP_6$, respectively, that extends through central axes of the contact channels as described above with respect to FIG. 3. The contact sub-assembly 280 of the differential pair P5 and the contact sub-assembly 280 of the differential pair P6 are adjacent to each other and the respective contact planes $CP_5$ and $CP_6$ are perpendicular to each other. In particular embodiments, the contact plane $CP_6$ may not only extend through an inter-channel portion, open sides, and concave bodies as described above with respect to the contact plane $CP_1$, but may also extend through an inter-channel portion of the adjacent differential pair P5. Furthermore, in some embodiments, one contact sub-assembly 280 may be adjacent to two contact sub-assemblies 280 and perpendicular to both. For example, the contact sub-assembly 280 of the differential pair P5 is also oriented perpendicular to the contact sub-assembly 280 of the differential pair P4.

In some embodiments, a number of contact sub-assemblies 280 in the set 282 of contact sub-assemblies 280 may be a multiple of four. For example, in the illustrated embodiment, there are eight (8) contact sub-assemblies 280 comprising 16 pin contacts. In other embodiments, there may be four (4) contact sub-assemblies 280 comprising eight (8) contacts. Moreover, other embodiments may include twelve and sixteen contact sub-assemblies 280. However, in alternative embodiments, the contact sub-assemblies are not a multiple of four.

Figure 10:
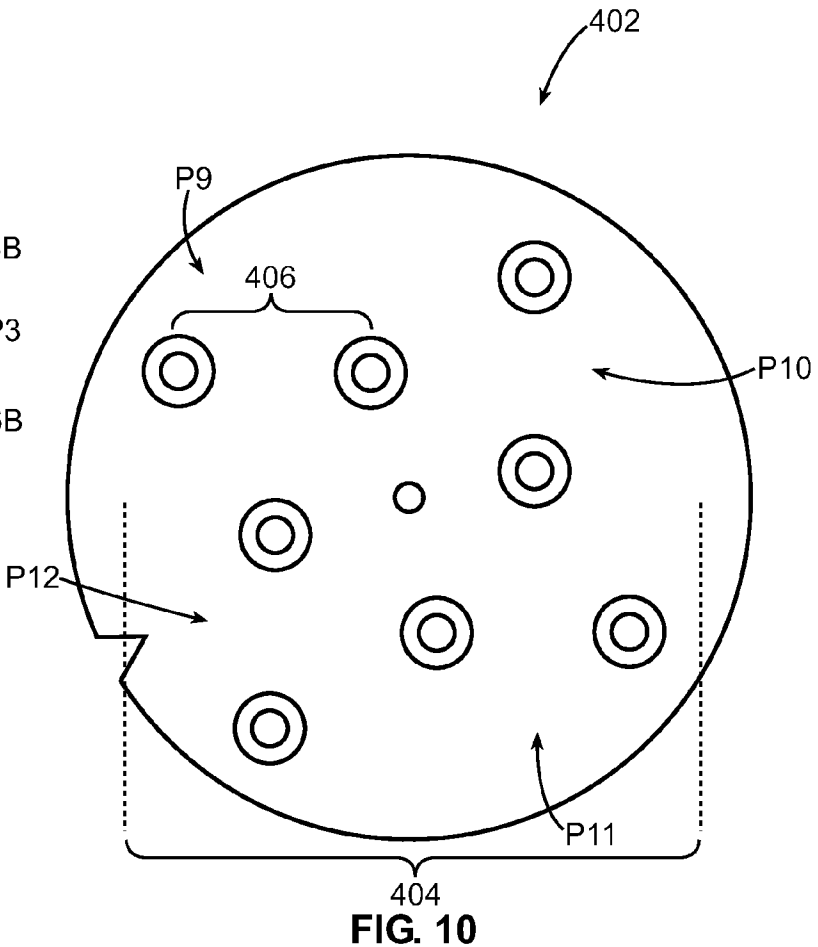
FIG. 10 is a front-end view of an electrical connector formed in accordance with another embodiment.

FIG. 10 is a front-end view of an electrical connector 402 formed in accordance with another embodiment that is similar to the electrical connector 100. The electrical connector 402 has a set 404 of contact sub-assemblies 406 that are similar to the contact sub-assemblies 280 described above. The contact sub-assemblies 406 constitute differential pairs P9-P12. As shown, each of the contact sub-assemblies 406 may be adjacent to only two other contact sub-assemblies 406. Moreover, each of the contact sub-assemblies 406 may be oriented perpendicular to the two other contact sub-assemblies 406.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. For example, the description of the pin contacts above may be similarly applied to socket contacts. Contact sub-assemblies may include socket contacts and retention clips. As such, if the following claims reference mating contacts, the mating contacts may be, for example, pin contacts and socket contacts.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a plug insert comprising a dielectric body and having a pair of contact channels extending therethrough, the contact channels having central axes that extend parallel to each other in a common direction, the contact channels being defined by respective channel walls and being separated by an inter-channel portion of the dielectric body, the channel walls having wall perimeters that extend around the corresponding central axes; and a contact sub-assembly held by the pair of contact channels, the contact sub-assembly comprising mating contacts that are received in the contact channels and retention clips that are positioned within the contact channels between the mating contacts and the channel walls, each of the retention clips having a concave body with clip edges separated by an open side, the concave body extending partially about the wall perimeter with the open side positioned along a portion of the wall perimeter, wherein the retention clips are oriented to face one another such that the inter-channel portion extends directly between the open sides of the retention clips.

2. The electrical connector in accordance with claim 1, wherein each of the wall perimeters includes inner and outer wall sections, the outer wall sections engaging the retention clips, the inter-channel portion of the dielectric body extending from the inner wall section of one contact channel to the inner wall section of the other contact channel, the inner wall sections interfacing with the open sides.

3. The electrical connector in accordance with claim 2, wherein the inner and outer wall sections have different shapes, the contours of the outer wall sections being configured to hold the respective retention clips.

4. The electrical connector in accordance with claim 2, wherein the inner wall section has a first semi-circle shape and the outer wall section has a second semi-circle shape, the first and second semi-circle shapes having different radiuses of curvature.

5. The electrical connector in accordance with claim 1, wherein the central axes extend parallel to and within a contact plane, wherein the contact plane intersects the mating contacts, the inter-channel portion, and the concave bodies of the retention clips.

6. The electrical connector in accordance with claim 5, wherein the contact sub-assembly is a first contact sub-assembly and the electrical connector further comprises a second contact sub-assembly that is adjacent to the first contact sub-assembly, the contact planes of the first and second contact sub-assemblies being perpendicular to each other.

7. The electrical connector in accordance with claim 6, wherein the electrical connector includes a set of contact sub-assemblies including the first and second contact sub-assemblies, a number of contact sub-assemblies in the set of contact sub-assemblies being a multiple of four.

8. The electrical connector in accordance with claim 1, wherein the dielectric body comprises a dielectric material, and wherein a material that separates the mating contacts is exclusively the dielectric material of the inter-channel portion between the open sides.

9. The electrical connector in accordance with claim 1, wherein the retention clips have inner surfaces that define corresponding contact-reception spaces and comprise resilient flex fingers that extend into the contact-reception spaces, the mating contacts deflecting the flex fingers radially outward when moving through the contact-reception spaces.

10. The electrical connector in accordance with claim 1, wherein the mating contacts comprise a differential pair of mating contacts.

11. The electrical connector in accordance with claim 10, wherein data signals are capable of being transmitted through the mating contacts at high speeds greater than or equal to 10G Ethernet.

12. The electrical connector in accordance with claim 1, wherein the plug insert comprises a base body and a cap body, the base body having a forward-facing surface and clip-receiving cavities that extend from the forward-facing surface into the base body, the clip-receiving cavities receiving the retention clips, the cap body engaging the forward-facing surface to confine the retention clips within the clip-receiving cavities.

13. The electrical connector in accordance with claim 1, wherein the mating contacts comprise differential pairs of mating contacts.

14. An electrical connector comprising:

a plug insert comprising a dielectric body and having a plurality of contact channels extending therethrough, the contact channels having central axes that extend parallel to each other in a common direction, the contact channels being defined by respective channel walls, the channel walls having wall perimeters that extend around the corresponding central axes, wherein the plurality of contact channels include associated pairs of contact channels, the contact channels of each of the associated pairs being separated by a corresponding inter-channel portion of the dielectric body; and a set of contact sub-assemblies held by the plug insert, each of the contact sub-assemblies comprising:

mating contacts received in one associated pair of contact channels, a contact plane extending in the common direction and through the central axes of said associated pair of contact channels; and retention clips positioned within the contact channels, each of the retention clips having a concave body with clip edges separated by an open side, the concave body extending partially about the corresponding wall perimeter with the open side positioned along a portion of the corresponding wall perimeter, the retention clips being oriented to face one another such that the inter-channel portion extends directly between the open sides of the retention clips;

wherein the set of contact sub-assemblies includes two adjacent contact sub-assemblies, the contact planes of the adjacent contact sub-assemblies extending perpendicular to each other.

15. The electrical connector in accordance with claim 14, wherein each of the wall perimeters includes inner and outer wall sections, the outer wall sections interfacing with the corresponding retention clips, the inter-channel portion of the dielectric body extending from the inner wall section of one contact channel to the inner wall section of the other contact channel, the inner wall sections at least partially defining the open sides.

16. The electrical connector in accordance with claim 15, wherein the inner and outer wall sections have different shapes, the contours of the outer wall sections being configured to hold the corresponding retention clips.

17. The electrical connector in accordance with claim 14, wherein each of the contact planes of said two adjacent contact sub-assemblies intersects the mating contacts, the inter-channel portion, and the concave bodies of the respective contact sub-assembly.

18. The electrical connector in accordance with claim 17, wherein the contact plane of one of said adjacent contact sub-assemblies intersects the inter-channel portion of the other of said adjacent contact sub-assemblies.

19. The electrical connector in accordance with claim 14, wherein a number of contact sub-assemblies in the set of contact sub-assemblies is a multiple of four.

20. The electrical connector in accordance with claim 14, wherein the retention clips have inner surfaces that define corresponding contact-reception spaces and comprise resilient flex fingers that extend into the contact-reception spaces, the mating contacts deflecting the corresponding flex fingers radially outward when moving through the contact-reception spaces.

* * * * *

UNITED STATES PATENT AND TRADEMARK OFFICE

CERTIFICATE OF CORRECTION

PATENT NO. : 8,029,322 B1
APPLICATION NO. : 12/891118
DATED : October 4, 2011
INVENTOR(S) : Lawrence Se-Jun Oh It is certified that error appears in the above-identified patent and that said Letters Patent is hereby corrected as shown below:

Page 1, First Page, Col. 1 (Inventors), line 2 (Inventors Name): Delete "Graham Henry Smith, Jr." and insert -- Graham Harry Smith, Jr. --, therefor.

Signed and Sealed this
Twenty-fourth Day of April, 2012

David J. Kappos

David J. Kappos
*Director of the United States Patent and Trademark Office*